US006161790A

United States Patent [19]

Westrich

[11] Patent Number: 6,161,790

[45] Date of Patent: Dec. 19, 2000

[54] METHOD AND APPARATUS FOR WINDING AN ADVANCING YARN

[75] Inventor: Hermann Westrich, Wuppertal, Germany

[73] Assignee: Barmag AG, Remscheid, Germany

[21] Appl. No.: 09/183,377

[22] Filed: Oct. 30, 1998

[30] Foreign Application Priority Data

Oct. 31, 1997 [DE] Germany ..... 197 48 280

[51] Int. Cl.[7] ..... B65H 54/52; B65H 54/44

[52] U.S. Cl. ..... 242/486.4; 242/474.5; 242/474.6

[58] Field of Search ..... 242/474.5, FOR 134, 242/474.6, 486.4

[56] References Cited

U.S. PATENT DOCUMENTS 5,029,762 7/1991 Behrens et al. ..... 242/474.5 X
5,100,072 3/1992 Behrens et al. ..... 242/474.5
5,526,995 6/1996 Westrich et al. ..... 242/474.5
5,595,351 1/1997 Haasen ..... 242/477.6

*Primary Examiner*—Donald P. Walsh
*Assistant Examiner*—Collin A. Webb
*Attorney, Agent, or Firm*—Alston & Bird LLP

[57] ABSTRACT

A method and apparatus for winding a continuously advancing yarn to form a package, wherein the package is wound on a driven winding spindle that is mounted in cantilever fashion on a movable spindle support. A contact roll lies with a contact force against the circumference of the package. The contact roll is likewise mounted on a movable support, and during the winding cycle, the center distance between the package and the contact roll is increased by a deflection of the spindle support. In this process the drive of the spindle support is controlled by means of a control device which is connected to a sensor that detects the lift of the contact roll. In accordance with the invention, the drive of the spindle support is driven at a deflection speed when the contact roll is outside of its desired range, and at a lower reversing speed when the contact roll is in its desired range.

15 Claims, 4 Drawing Sheets

METHOD AND APPARATUS FOR WINDING AN ADVANCING YARN

BACKGROUND OF THE INVENTION

The invention relates to a method and apparatus for winding an advancing yarn to form a yarn package.

When winding a continuously advancing yarn to form a yarn package with a contact roll lying with a contact force against the circumference of the package, the increase of the package diameter is made possible by a deflection of the package mounted on the winding spindle support or by a deflection of the contact roll. In this process, the contact remains between the package and the contact roll, so as to generate a predetermined contact force on the package surface.

EP 0 374 536 and corresponding U.S. Pat. No. 5,029,762 disclose a yarn winding machine, wherein the deflection of the winding spindle supporting the package is controlled during the winding cycle as a function of the position of the contact roll. In so doing, the lifting movement of the contact roll is detected by a sensor. To this end, the contact roll is mounted for movement in such a manner that it can perform a lifting movement radially to the package being wound. Once the contact roll leaves a desired position, the sensor generates a signal and supplies same to a controller. The controller controls the drive of a spindle support mounting the winding spindle, so that the package performs a deflection until the contact roll reaches again its desired range. During this two-position control, the spindle support is moved at a constant speed. This results in that relatively significant controlling efforts must be made in particular at the beginning of the winding cycle. In addition, the stepwise drive control of the spindle support leads to an unavoidable change in the contact force between the package and the contact roll.

It is accordingly an object of the invention to further develop a method of the initially described kind as well as a winding machine for winding a continuously advancing yarn such that the center distance between the contact roll and the package is changed substantially proportionately to the increasing diameter, while keeping control efforts at a minimum.

SUMMARY OF THE INVENTION

The above and other objects and advantages of the present invention are achieved by the provision of a winding method and apparatus wherein the surface of the package being formed is engaged with a contact roll, with the contact roll being mounted for limited movement in a direction away from the package as the package builds.

The movement of the contact roll is sensed and the support spindle is driven at a predetermined deflection speed $V_A$ in response to a sensed movement of the contact roll outside of a predetermined range of movement so as to increase the distance between the contact roll and the package and maintain the positioning of the contact roll within the predetermined range of movement during the build of the package. Also, when the contact roll is within the predetermined range of movement, the spindle support is driven at a reversing speed $V_U$ which is lower than the deflection speed $V_A$ and which is lower than or equal to a winding speed $V_S$ which is a function of the rate of the diameter increase of the package so that the position of the contact roll remains substantially unchanged.

When winding a yarn at a substantially constant yarn speed, the diameter increase in the course of time is dependent on the respective package diameter. Thus, in the case of a small package diameter, the outside diameter of the package will increase substantially faster than in the case of a large outside diameter, while the yarn length wound per unit time is the same. The diameter increase per unit time may therefore be considered a function of the outside diameter of the package. This diameter increase in the course of time determines the change in the center distance between the package and the contact roll. The invention establishes a relationship between the deflection of the winding spindle for increasing the center distance between the contact roll and the package and the diameter increase of the package that is dependent the package diameter. The deflection of the winding spindle occurs at different speeds. In the phase wherein the contact roll is removed from its desired range, the controller receives a sensor signal which then controls the drive of the spindle support at the deflection speed $V_A$. As soon as the contact roll reaches again its desired range, and the sensor thus ceases to generate a signal, the drive of the winding spindle support is changed over to the reversing speed $V_U$. The reversing speed $V_U$ is lower than the deflection speed $V_A$ and preferably lower than the predetermined winding speed $V_S$. In this connection, the winding speed $V_S$ is the speed of the spindle support, at which the deflection of the package just corresponds to the diameter increase in the course of time, so that the contact roll remains unchanged in its position. The winding speed becomes lower and lower as the package diameter increases. This means that likewise the reversing speed becomes lower after each changeover.

The invention has the advantage that the contact pressure between the contact roll and the package shows a more regular distribution. The switching frequency of the controller is considerably reduced, since the contact roll remains in the desired range over substantially longer periods of time.

The predetermined winding speed $V_S$ is dependent on the diameter increase of the package in the course of time. In this connection, the diameter increase of the package during a winding cycle is determined by the parameters yarn speed, time, packing density of the package, yarn denier, traverse stroke, as well as the momentary package diameter. For example, since the packing density is varied during the winding cycle, the winding speed can be predetermined only approximately at the beginning of the winding cycle.

In a particularly advantageous embodiment of the method, the winding speed is computed from a quantity that characterizes the diameter increase of the package in the course of time, and the package diameter. The relation may be expressed by the following mathematic equation:

$$V_S=(K^2/2)(1/d)$$

where $V_S$ is the winding speed, K the characteristic quantity of the diameter increase, and d the package diameter. The winding speed is computed directly before each changeover from the deflection speed to the reversing speed, and vice versa. It is thus ensured that the winding spindle support is always operated at a speed which is close to the winding speed.

For a continuous determination of the diameter of the package being wound, it will be advantageous to determine the package diameter from the rotational speed of the contact roll and from the rotational speed of the winding spindle. The special advantage lies in that no additional device is needed to determine the package diameter. To keep the yarn tension substantially constant during the winding, the winding speed is controlled with the aid of the contact roll. In this connection, the rotational speed of the contact is constantly determined and compared with a predetermined desired value. The desired value predetermines a constant speed of the contact roll. Should the actual speed deviate from the desired speed, the drive of the winding spindle will be controlled such that the desired speed adjusts itself on the contact roll. These data that are already available in a yarn winding machine may be used in this variant of the method to determine the package diameter at the same time.

The characteristic quantity K, which characterizes the diameter increase of the package in the course of time, can be determined during the winding cycle when the support of the winding spindle is stopped.

When the contact roll is within its predetermined range, the reversing speed $V_U$ may be constantly reduced as the package diameter increases. This serves to minimize the switching frequency for a changeover from the deflection speed to the reversing speed. In this process, the contact pressure between the contact roll and the package surface is reduced to a more regular distribution.

To ensure that the contact roll performs during the changeover phase a movement radial of the package, a ratio of the speeds $(V_U/V_S) \leqq 1$ is defined and kept substantially constant during the entire winding cycle irrespective of the package diameter.

Should the contact roll leave its desired range during the winding cycle, the drive of the spindle support will be switched to the deflection speed $V_A$. The deflection speed $V_A$ is selected such that it is always higher than the winding speed $V_S$. It is thus accomplished that the contact roll returns relatively quickly to its desired range. This measure allows to maintain the phases of the winding cycle short, during which the contact roll is outside of its desired range, and to keep the phases as long as possible, during which the contact roll maintains its desired range.

The winding machine of the present invention is characterized by its simple concept of control while maintaining the advantages of a two-position control. Thus, no undefined conditions are reached during the winding of the package. Due to the surface contact between the contact roll and the package, the package diameter is constantly sensed. Since the speeds are predetermined, the contact roll and package are unable to drift away from each other.

The signals generated for controlling the winding speed may be simultaneously used for determining the speeds for controlling the spindle support.

BRIEF DESCRIPTION OF THE DRAWINGS

In the following, further advantages of the method in accordance with the invention are described in more detail with reference to an embodiment illustrated in the following drawings, in which.

BRIEF DESCRIPTION OF THE PREFERRED EMBODIMENTS

Figure 1:
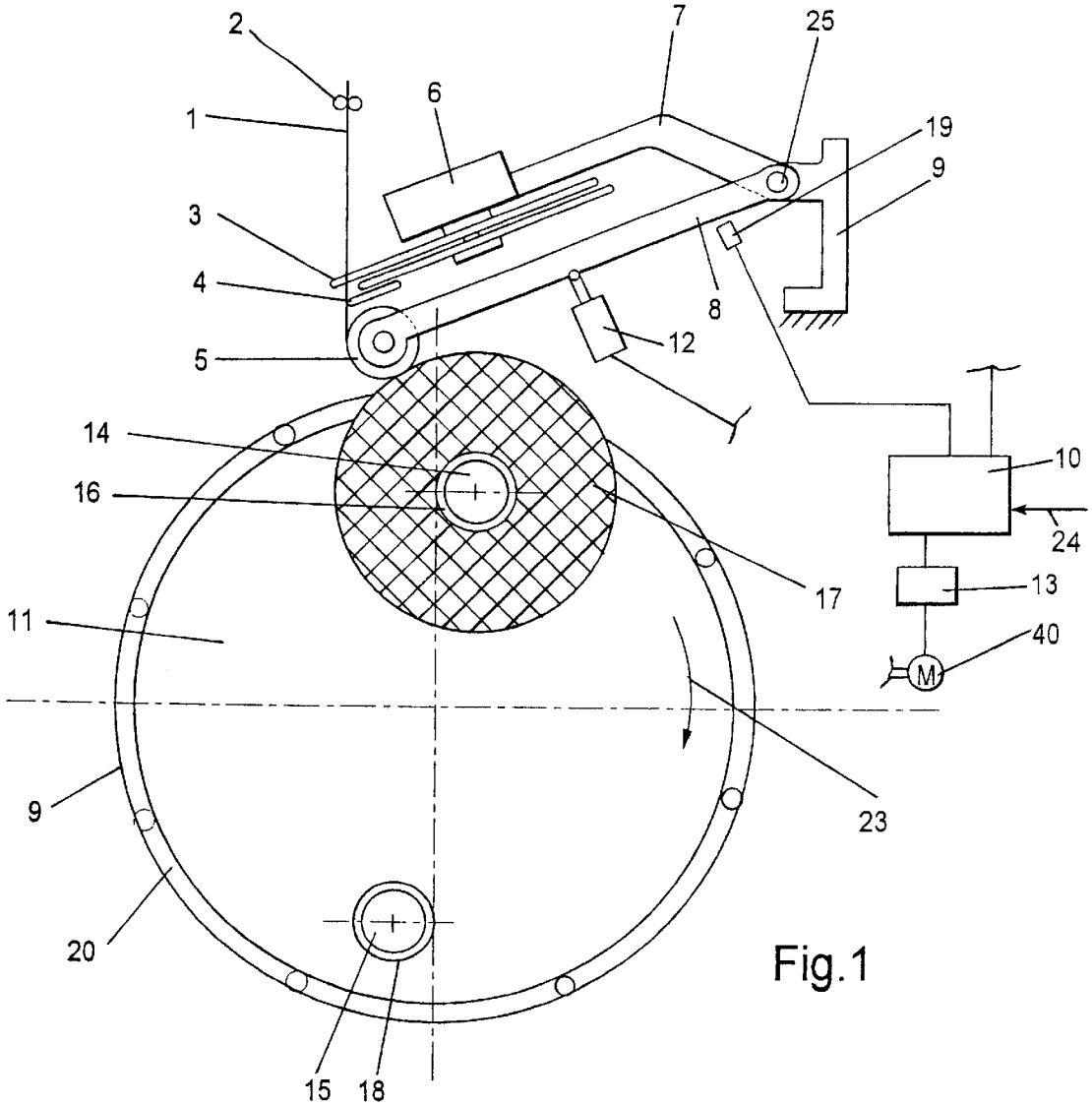
FIG. 1 is a side view of a winding machine in operation.
Figure 2:
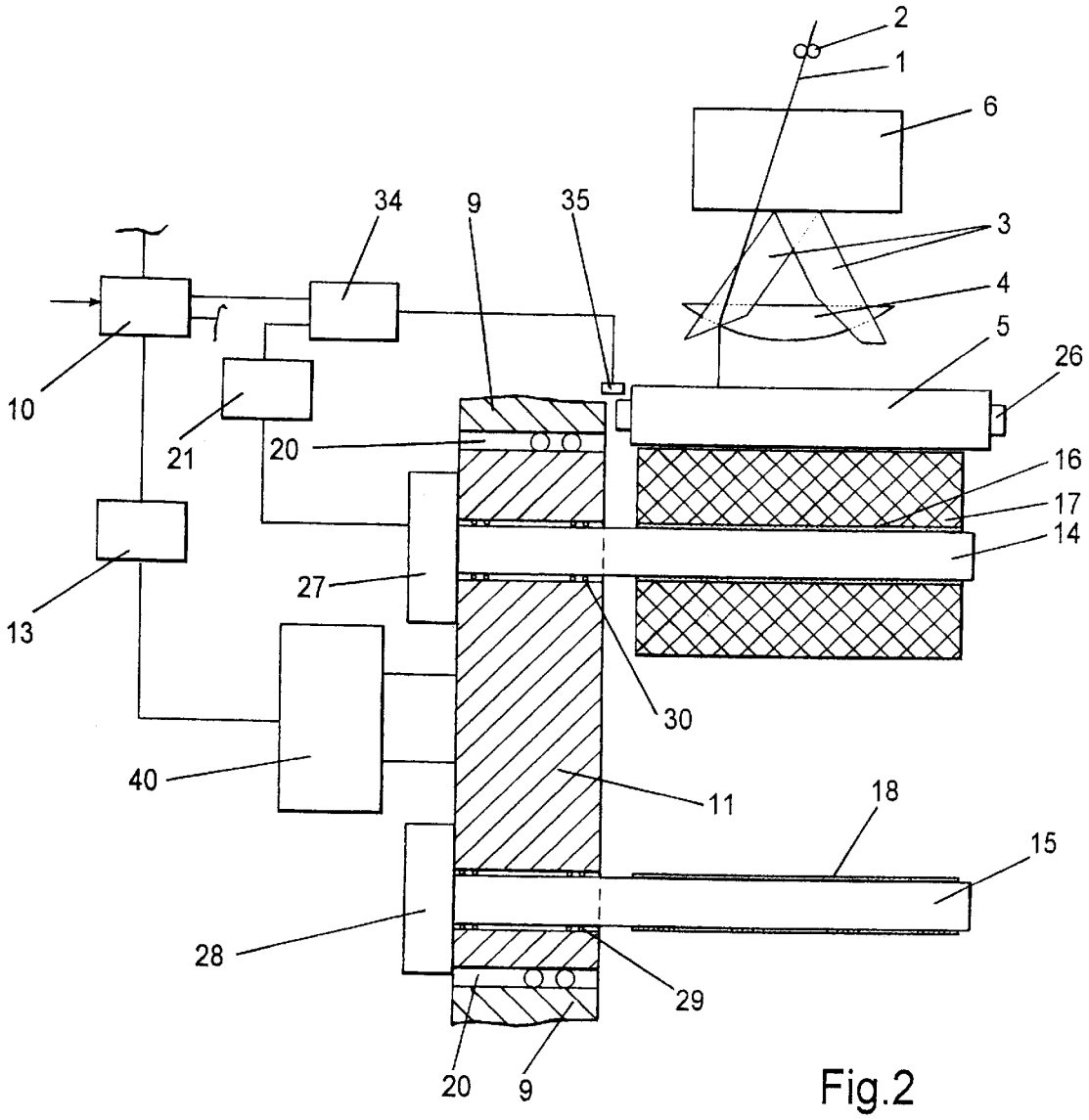
FIG. 2 is a front view of the winding machine of FIG. 1 in operation.

The winding machine shown in FIGS. 1 and 2 comprises a turret-type spindle support 11, which is rotatably mounted by means of a bearing 20 in a machine frame 9. The spindle support 11 is driven by an electric motor 40. The spindle support 11 mounts in cantilever fashion, for off-center rotation, two winding spindles 14 and 15, 180° out of phase. As can be noted from FIG. 1, the winding spindle 14 is in an operating position in a winding range, and the winding spindle 15 in a standby position in a doffing range of the winding machine.

A yarn 1 advances to the winding machine at a constant speed. The yarn 1 passes first through a yarn guide 2 which forms the apex of a traversing triangle. Subsequently, the yarn reaches a traversing mechanism. The traversing mechanism of the illustrated embodiment includes a traverse drive 6 and rotary blades 3. The rotary blades 3 alternate in reciprocating the yarn 1 along a guide bar 4 within the limits of a traverse stroke. The yarn traversing mechanism is mounted for movement in the machine frame 9 of the winding machine. To this end, a support 7 is used whose free end mounts the traverse mechanism, and which is mounted with its other end for pivotal movement such that the traverse mechanism is able to perform a movement relative to itself and to the contact roll 5, namely a parallel displacement.

Downstream of the traversing mechanism, the yarn is deflected about a contact roll 5 by more than 90°, and subsequently wound on a package 17. The package 17 is wound on an empty tube 16. The winding tube 16 is mounted on the freely rotatable winding spindle 14. The winding spindle 14 with winding tube 16 and package 17 being wound thereon is in a central winding range.

The winding spindle 14 is mounted in the spindle support 11 by means of a bearing 30. The winding spindle 14 is driven by a winding spindle drive 27, which is realized, for example, by a synchronous or asynchronous motor. The winding spindle drive 27 is mounted on spindle support 11 in alignment with the spindle 14. The winding spindle drive 27 is supplied with a three-phase current of controllable frequency by a frequency changer 21. The frequency changer 21 is controlled by a controller 34 which is activated by a rotational speed sensor 35. The rotational speed sensor 35 senses the rotational speed of the contact roll 5. The controller 34 controls the frequency changer 21 of the winding spindle 14 such that the rotational speed of the control roll 5 and thus likewise the surface speed of the package 17 remain constant despite an increasing package diameter.

If the winding spindle drive 27 is formed by an asynchronous motor, the rotational speed of the winding spindle will be detected by a rotational speed sensor (not shown). The signal of the rotational speed sensor is supplied to the controller 34. The controller 34 now adjusts in an inner loop the rotational speed of the winding spindle to a constant value. The signal of the rotational speed sensor 35 which senses the rotational speed of the contact roll, leads in an outer control loop to varying the rotational speed of the winding spindle.

The second winding spindle 15 is mounted off center on spindle support 11 by means of a bearing 29, and driven by means of a winding spindle drive 28. The winding spindle drive 28 is currently deactivated, since the winding spindle 15 is on standby for exchanging a full package against an empty tube 18.

The spindle support 11 is mounted for rotation in the machine frame 9 of the winding machine, and driven by a drive 40, for example, a frequency-controlled electric motor, in the direction of rotation 23. The electric motor 40 is, for example, an asynchronous motor. The electric motor 40 is used to rotate spindle support 11 in the sense of enlarging the center distance between contact roll 5 and winding spindle 14 when the package diameter increases. To this end, the electric motor 40 is frequency-controlled via a final control element 13, so that the spindle support 11 is able to realize any desired speed in the direction of rotation 23. In this connection, however, it would also be possible to impart to the spindle support, in combination with a reversal of polarity, a rotation opposite to the direction of rotation 23.

As shown in FIG. 1, the contact roll 5 is mounted to a support 8. The contact roll support 8 is constructed as a rocker arm, so that the contact roll is able to perform a movement with a radial component to the winding spindle 14. The rocker arm 8 is mounted on machine frame 9 for pivotal movement about an axis of rotation 25. A pressure-relieving device 12, which can be pneumatically biased, and which acts upon the rocker arm 8 from the bottom against the weight thereof, permits full or partial compensation of the weight that rests upon the contact roll and thus as a contact force on the package 17, so that it is possible to make a fine adjustment of a basic value of the desired contact force between the contact roll and the package surface. The pressure-relieving device 12 may be controlled via a control device (not shown). Below rocker arm 8, a sensor 19 is arranged. The sensor 19 detects the lift of the contact roll 5 or the angle of traverse of rocker arm 8 relative to the machine frame 9. Therefore, it would be possible to provide the sensor in the form of an angle detecting element. The sensor 19 is connected to a control device 10. The control device 10 is furthermore coupled with the controller 34 and frequency changer 13.

The operation of the winding machine is described in the following:

The package 17 is wound on tube 16. As the package diameter increases, the spindle support 11 moves continuously at a predetermined reversing speed in the direction of rotation 23. The reversing speed is controlled by the final control element 13 and the electric motor 40. To this end, the final control element 13 is connected to control device 10. In the control device 10, the momentarily wound package diameter is computed by a computing unit on the basis of the rotational speeds of contact roll 5 as received from controller 34 and the rotational speed of winding spindle 14. Thus, it is possible to determine from a master curve between the package diameter and a winding speed of the spindle support, which is stored in the control device 10, the winding speed of the spindle support that is associated to the momentary package diameter. The winding speed is in this instance exactly the speed of the spindle support, which ensures an unchanged position of the contact roll while maintaining the circumferential contact between the contact roll and the package. The master curve is supplied to the control device 10 via an input 24. The control device 10 supplies a corresponding control signal to final control element 13, so that the electric motor 40 is operated at a reversing speed, which is lower than the winding speed. Were the reversing speed of the spindle support exactly adapted to the diameter increase, the contact roll 5 would remain unchanged in is position. However, the reversing speed is somewhat slower than the winding speed, so that the position of the contact roll changes. As soon as the contact roll 5 leaves its desired range, the sensor 19 will generate a signal. The sensor 19 supplies its signal direct to control device 10. In the control device 10, the reversing speed is changed to the deflection speed by means of a reversing device. The deflection speed is higher than the winding speed, so that the contact roll is returned to its desired range. Thus, the contact force that is adjusted between the contact roll and the package remains substantially unchanged.

With the aid of the signals supplied by controller 34, it is also possible to compute the diameter increase per unit time. Thus, it is possible to adapt the predetermined winding speed to the actual diameter increase. In this instance, the control unit 10 includes a computing unit, which conducts—during each reversal—a continuous or stepwise computation of the package diameter increase and corrects and computes the winding speed. This determined function of the winding speed is taken by the control device 10 as a basis for determining the reversing and the deflection speed.

Figure 3:
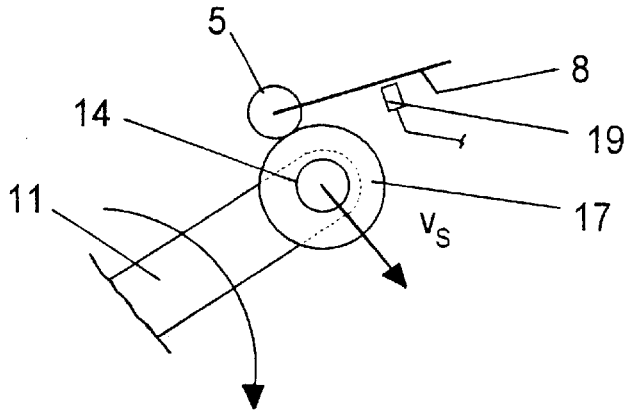
FIGS. 3–5 are each a fragmentary schematic view of the winding machine in operation.
Figure 4:
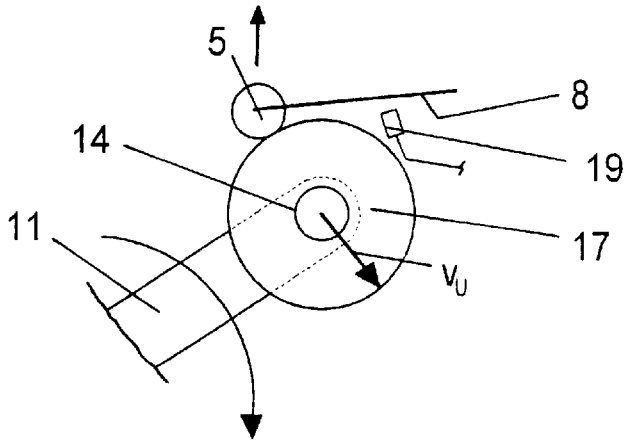
Figure 5:
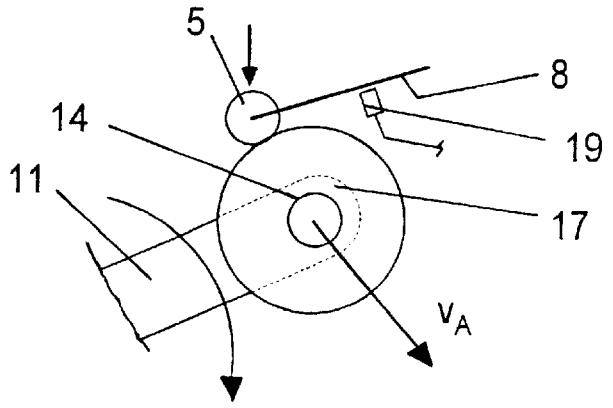

FIGS. 3–5 are schematic views showing the cooperation of the deflection of the winding spindle and the contact roll during a winding cycle in accordance with the invention. In this instance, the contact roll 5 is mounted on a movable support 8. Below the contact roll support 8, a sensor 19 is arranged, which is connected to a control device (not shown). The contact roll 5 lies against the circumference of a package 17 being wound. The package 17 is mounted on a driven winding spindle 14. The winding spindle 14 is arranged in cantilever fashion on a spindle support 11. The spindle support 11 can be driven in the direction of movement indicated by an arrow.

Shown in FIG. 3 is a situation, in which the spindle support 11 is driven such that the winding spindle 14 moves at the winding speed $V_S$ in the direction of enlarging the center distance between the contact roll and the winding spindle. In this situation, the contact roll 5 remains unchanged in its position. The winding speed $V_S$ is in this instance the speed, which facilitates an enlargement of the package when the contact roll lies against the package circumference, without the contact roll changing its position. Thus, the winding speed $V_S$ is determined by the diameter increase per unit time of the package 17 being wound. However, besides other factors, the amount of yarn that is wound on the package per unit time is dependent on the package buildup, the yarn denier, and the packing density. These quantities may, however, fluctuate during a winding cycle, so that a predetermination of the winding speed requires a constant inclusion of all winding parameters and, thus, represents increased computing efforts. In accordance with the invention, this can be avoided in that the spindle support 11 is operated at different speeds which represent an adaptation to the winding speed.

Shown in FIG. 4 is the situation, in which the spindle support 11 is driven at the reversing speed $V_U$. The reversing speed $V_U$ is lower than the winding speed $V_S$. Thus, as a function of the difference between the winding speed and the reversing speed, the contact roll 5 will move in a direction radial of the package. This lifting movement as indicated by an arrow results in that the contact roll 5 leaves its desired range. The sensor 19, however, senses the lift of contact roll 5 and will generate a signal, as soon as the contact roll 5 leaves the desired range. The sensor signal is supplied to the control device that controls the drive of the spindle support. The control device then causes the drive of spindle support 11 to be changed. As a result, the spindle support 11 is driven at a deflection speed $V_A$. As shown in FIG. 5, the contact roll 5 returns in this phase to its desired range. This deflection speed $V_A$ is higher than the winding speed $V_S$. Thus, as a function of the difference between the deflection speed and the winding speed, the contact roll will perform a lifting motion in the reversed direction (arrow in FIG. 5) back to its desired range. As soon as the contact roll reaches its desired range, the sensor signal will be cancelled, and the control device switches the drive of spindle support 11 to the reversing speed $V_U$. Thus, the winding cycle proceeds by alternating between the reversing speed and the deflection speed, as shown in FIGS. 4 and 5. During the winding cycle, the speeds, in particular the reversing speed may be continuously reduced, so as to obtain a further adaptation to the winding speed. However, it is likewise possible to adjust the deflection speed especially high, so as to keep the phases as short as possible during the winding cycle, in which the contact roll is outside of its desired range.

Figure 6:
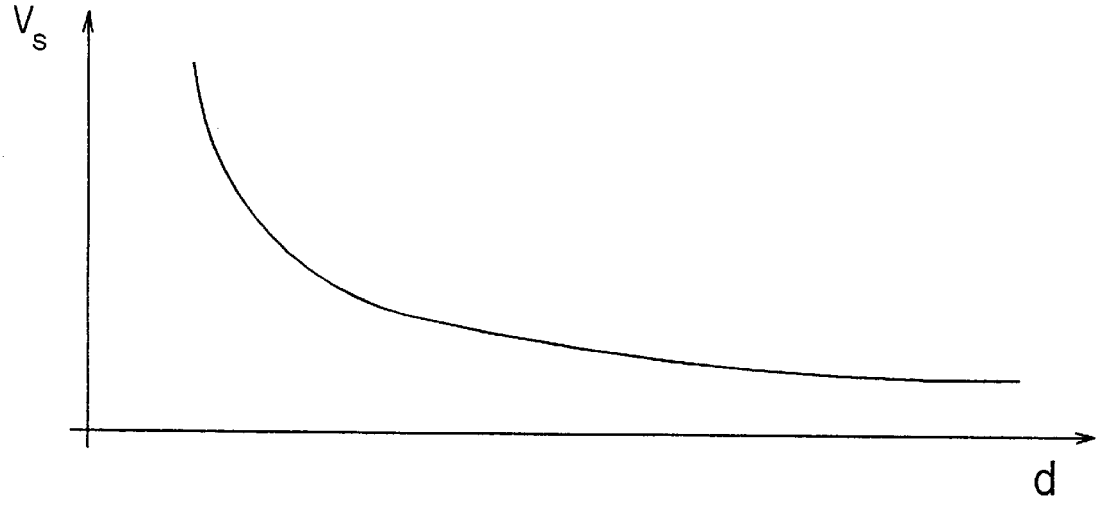
FIG. 6 is a diagram illustrating the variation of the winding speed during a winding cycle.

FIG. 6 is a diagram showing the relationship between the winding speed of the spindle support and the diameter of the package being wound. The package diameter is plotted on the abscissa indicated at d and the winding spindle $V_S$ on the ordinate. The relationship can be shown approximately by a hyperbolic curve. The winding speed of the spindle support decreases as the package diameter increases, and thus is inversely related to the diameter.

Figure 7:
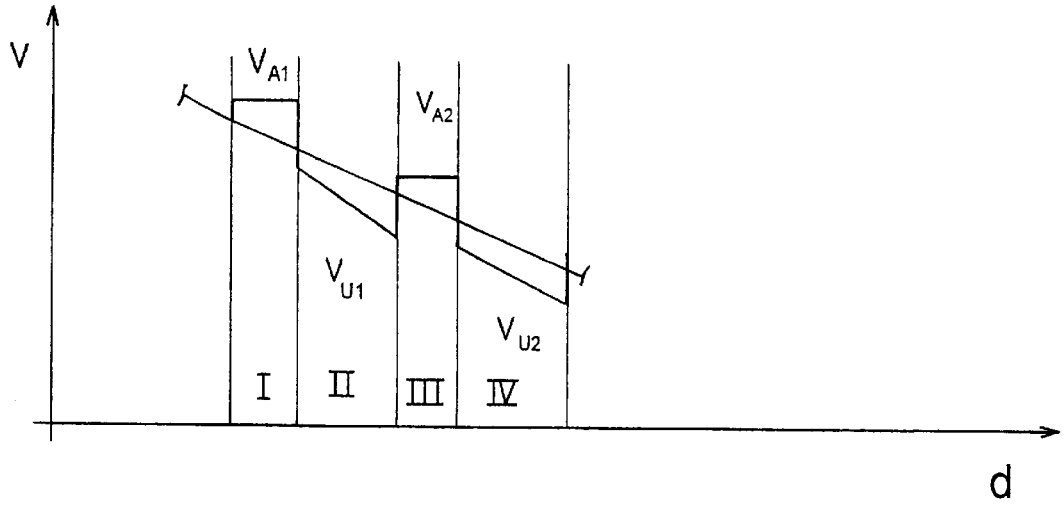
FIG. 7 is a diagram illustrating a speed variation during a changeover from the deflection speed to the reversing speed.

FIG. 7 is a sector of the curve of the winding speed of FIG. 6. This sector shows four directly successive phases I, II, III, IV that are traversed during a winding cycle. During a first phase I, the spindle support 11 of the winding machine is driven at deflection speed $V_{A1}$. At the beginning of this phase I, the deflection speed is higher than the winding speed. After the contact roll has reached again its desired range, the control device switches the drive of the spindle support to a reversing speed $V_{U1}$. In this phase, the spindle support is driven at the reversing speed $V_{U1}$. In phase II, the reversing speed is always lower than the winding speed $V_S$. Thus, in the course of time, the contact roll is removed from its desired range until the time, at which the sensor releases a signal . As soon as a signal is generated, the control device switches the drive, so that the spindle support is now driven at a deflection speed $V_{A2}$. Thus, in phase III, the contact roll moves back to its desired range. During the transition from phase III to phase IV, the drive is again switched by the control device to the reversing speed $V_{U2}$. The winding cycle continues in this sense until a full package is wound.

That which is claimed is:

1. A method of winding a continuously advancing yarn onto a bobbin tube to form a yarn package, with the bobbin tube being coaxially mounted on a winding spindle which is mounted in cantilever fashion on a moveable spindle support, and comprising the steps of engaging the surface of the package being formed with a contact roll, with the contact roll being mounted for limited movement in a direction away from the package as the package builds, sensing the movement of the contact roll and driving the spindle support at a predetermined deflection speed $V_A$ in response to a sensed movement of the contact roll outside of a predetermined range of movement so as to increase the distance between the contact roll and the package and maintain the positioning of the contact roll within the predetermined range of movement during the build of the package, and when the contact roll is within the predetermined range of movement, driving the spindle support at a reversing speed $V_U$ which is lower than the deflection speed $V_A$ and which is lower than or equal to a winding speed $V_S$ which is a function of the rate of the diameter increase of the package wherein the position of the contact roll remains substantially unchanged.

2. The method as defined in claim 1 wherein the winding speed $V_S$ is predetermined as a function of the package diameter from a quantity characterizing the diameter increase of the package in the course of time and the package diameter.

3. The method as defined in claim 2 wherein the package diameter is determined by the ratio of the rotational speed of the contact roll to the rotational speed of the winding spindle.

4. The method as defined in claim 2 wherein the characterizing quantity is determined during the winding cycle when the support of the winding spindle is stopped.

5. The method as defined in claim 1 wherein in the predetermined range of the contact roll, the reversing speed $V_U$ is constantly reduced as the package diameter increases.

6. The method as defined in claim 5 wherein the ratio of the speeds $V_U/V_S$ is substantially constant irrespective of the package diameter.

7. The method as defined in claim 1 wherein the deflection speed $V_A$ is higher than the winding speed $V_S$.

8. A method of winding a continuously advancing yarn onto a bobbin tube to form a yarn package, with the bobbin tube being coaxially mounted on a winding spindle which is mounted in cantilever fashion on a moveable spindle support, and comprising the steps of engaging the surface of the package being formed with a contact roll, with the contact roll being mounted for limited movement in a direction away from the package as the package builds, when the contact roll is within a predetermined range of movement, driving the spindle support so as to increase the distance between the contact roll and the package at a reversing speed $V_U$ which is lower than or equal to a winding speed $V_S$ which is inversely related to the diameter of the package, and when the contact roll is outside the predetermined range of movement, driving the spindle support so as to increase the distance between the contact roll and the package at a deflection speed $V_A$ which is greater than the winding speed $V_S$.

9. The method as defined in claim 8 wherein the winding speed $V_S$ is the speed of the movement of the spindle support at which the contact roll remains substantially unchanged in its position.

10. An apparatus for continuously winding an advancing yarn onto a bobbin tube to form a yarn package, and comprising a bobbin tube winding spindle mounted in cantilever fashion on a moveable spindle support, a contact roll, means mounting the contact roll at a location so as to be in circumferential contact with the package being wound, and with said mounting means permitting limited movement in a direction away from the package, a sensor for monitoring the movement of the contact roll away from the package and providing an output signal which is in response thereto, a drive for moving the movable spindle support away from the contact roll, and a control connected to the sensor for controlling the drive so as to increase the distance between the contact roll and the package at a deflection speed $V_A$ when the output signal indicates that the contact roll is outside of a predetermined range of movement and at a reversing speed $V_U$ when the output signal indicates that the contact roll is within the predetermined range of movement, with the reversing speed $V_U$ being less than the deflection speed $V_A$ and less than or equal to a winding speed $V_S$ which is inversely related to the diameter of the package.

11. The winding apparatus as defined in claim 10 wherein the control includes a controller which determines the package diameter from the rotational speed of the winding spindle and the rotational speed of the contact roll.

12. The winding apparatus as defined in claim 11 wherein the control further includes a computing unit which computes, utilizing the package diameter provided by the controller, a winding speed $V_S$ where the position of the contact roll remains substantially unchanged.

13. The winding apparatus as defined in claim 12 wherein the means mounting the contact roll includes a rocker arm pivotally mounted on a machine frame, and wherein the position sensor includes an angle detecting element that senses the angular position of the rocker arm.

14. The apparatus as defined in claim 10 wherein the winding $V_S$ is the speed of the movement of the spindle support at which the contact roll remains substantially unchanged in its position.

15. The apparatus as defined in claim 14 wherein the deflection speed $V_A$ is greater than the winding speed $V_S$.

* * * * *